US008832902B2

(12) United States Patent
Kim et al.

(10) Patent No.: US 8,832,902 B2
(45) Date of Patent: Sep. 16, 2014

(54) ROBOT CLEANER

(75) Inventors: Sung-Guen Kim, Changwon-si (KR); In-Bo Shim, Changwon-si (KR); Byung-Doo Yim, Changwon-si (KR); Ji-Hoon Sung, Changwon-si (KR); Bong-Ju Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 258 days.

(21) Appl. No.: 13/266,401

(22) PCT Filed: Jun. 30, 2009

(86) PCT No.: PCT/KR2009/003562
§ 371 (c)(1),
(2), (4) Date: Dec. 7, 2011

(87) PCT Pub. No.: WO2011/002113
PCT Pub. Date: Jan. 6, 2011

(65) Prior Publication Data
US 2012/0090133 A1 Apr. 19, 2012

(51) Int. Cl.
*A47L 9/00* (2006.01)
*A47L 5/00* (2006.01)
*A47L 9/04* (2006.01)

(52) U.S. Cl.
CPC ..... *A47L 9/0411* (2013.01); *A47L 9/0433* (2013.01); *A47L 9/0444* (2013.01); *A47L 2201/00* (2013.01); *A47L 9/0455* (2013.01); *A47L 9/0488* (2013.01)
USPC ..... 15/392; 15/383

(58) Field of Classification Search
USPC ..... 15/382, 383, 391, 392, 415.1; 901/11, 901/40
See application file for complete search history.

(56) References Cited

U.S. PATENT DOCUMENTS

| | | | | |
|---|---|---|---|---|
| 3,671,996 | A | 6/1972 | Gaudry | |
| 3,959,847 | A * | 6/1976 | Kaulig et al. | 15/368 |
| 4,847,944 | A | 7/1989 | Lackner | |
| 5,435,038 | A * | 7/1995 | Sauers | 15/182 |
| 5,452,490 | A * | 9/1995 | Brundula et al. | 15/182 |
| 6,314,611 | B1 * | 11/2001 | Sauers | 15/376 |

(Continued)

FOREIGN PATENT DOCUMENTS

| | | |
|---|---|---|
| KR | 10-1996-0003672 | 2/1996 |
| KR | 10-2004-0063164 A | 7/2004 |

(Continued)

*Primary Examiner* — Dung Van Nguyen
(74) *Attorney, Agent, or Firm* — McKenna Long & Aldridge, LLP

(57) ABSTRACT

According to an embodiment of the present disclosure, an installation structure for an agitator installed in a dust suction unit of a robot cleaner to scatter foreign substances distributed in a working area comprises: a holder which is connected to a driving motor for providing a torque to the agitator and has a part exposed to the inside of the dust suction unit; and a fixing shaft for forming a rotation shaft of the agitator and having a shape of a polygonal pillar or a shape of a pillar including at least one projection, wherein a shaft insertion part is formed in the holder, has a dented shape corresponding to the shape of the fixing shaft, and can be engaged and rotated with the fixing shaft while the fixing shaft is inserted into and installed at the holder. According to an embodiment of the present disclosure, the easy separation and installation of the agitator and the enablement of simultaneous rotation of the agitator and a side brush can improve user satisfaction.

11 Claims, 9 Drawing Sheets

(56) References Cited

U.S. PATENT DOCUMENTS

| | | | | |
|---|---|---|---|---|
| 6,324,714 | B1 * | 12/2001 | Walz et al. | 15/52.1 |
| 6,591,441 | B2 * | 7/2003 | Stegens et al. | 15/179 |
| 6,810,559 | B2 * | 11/2004 | Mertes et al. | 15/392 |
| 7,007,336 | B2 * | 3/2006 | Roney et al. | 15/179 |
| 2004/0244140 | A1 * | 12/2004 | Joo | 15/387 |
| 2006/0032013 | A1 | 2/2006 | Kim | |
| 2006/0272122 | A1 * | 12/2006 | Butler et al. | 15/383 |

FOREIGN PATENT DOCUMENTS

| | | | |
|---|---|---|---|
| KR | 10-2004-0105509 | | 12/2004 |
| KR | 10-2006-0042801 | | 5/2006 |
| KR | 10-2006-0131419 | | 12/2006 |
| KR | 10-2008-0000186 | | 1/2008 |
| WO | 2007-065034 | A1 | 6/2007 |
| WO | 2008-091199 | A1 | 7/2008 |

* cited by examiner

ROBOT CLEANER

This application is a 35 U.S.C. §371 National Stage Entry of International Application No. PCT/KR2009/003562, filed on Jun. 30, 2009, which is hereby incorporated by reference in its entirety for all purposes as if fully set forth herein.

TECHNICAL FIELD

The present disclosure relates to a robot cleaner.

BACKGROUND ART

A robot cleaner refers to a cleaning apparatus which removes dust or foreign substances from the floor of a working area it moves in without user control. It determines locations of obstacles or walls by using its sensor or camera and avoids them by using its location data while collecting dust along its path of movement.

Such a robot cleaner includes an agitator to increase the efficiency of sucking the dust scattered in its working area. Such an agitator scatters the dust in the working area while rotating by receiving a torque from the motor of the cleaner.

Generally, a belt connecting the rotation shaft of the suction motor with the body of the agitator is used to transmit the torque to the agitator, and the agitator body includes an inwardly recessed belt connecting part to connect the belt.

However, when the agitator has to be cleaned, the belt connecting the suction motor with the agitator body has to be removed first and then the agitator has to be taken apart.

After the cleaning is completed, the belt has to be installed at the agitator body and then the agitator has to be fixed rotatably inside the dust suction unit, which makes the disassembly and installation of the agitator difficult.

DISCLOSURE OF THE INVENTION

Technical Problem

Embodiments provide a robot cleaner an agitator can be removed from and installed at with ease.

Embodiments also provide a robot cleaner which rotates an agitator by using a torque of a motor to rotate a side brush.

Technical Solution

In one embodiment, a robot cleaner includes: a main body in which a dust suction unit is disposed; holders disposed at sides of the dust suction unit; and an agitator installed on the holders to remove foreign substances from a working area. The agitator includes a fixing shaft having a non-circular shape and providing a rotation center, and the holder includes a shaft insertion part in which the fixing shaft is inserted.

Advantageous Effects

According to the embodiment, a driving force transmitter, such as a belt and a chain, which transmits a driving force to the body of the agitator is not coupled directly but a fixing shaft forming a rotation shaft is connected to a driving motor and put in a rotating holder.

The holder includes a shaft insertion part which corresponds in shape to the fixing shaft, and the fixing shaft put in the shaft insertion part does not rotate alone but rotates together with the holder in engagement.

By a coupling hole formed at a side of the holder, the fixing shaft of the agitator may be put in the holder from the side of the holder, facilitating the installation of the agitator. Since the fixing shaft can be removed from the holder by pulling the agitator, the abovementioned agitator installation structure facilitates the disassembly of the robot cleaner of the embodiment when the robot cleaner has to be disassembled for cleaning or component replacement.

The holder is connected to a side of a pulley transmitting the torque to the agitator, and a worm can be installed at the other side of the pulley to provide the torque to the side brush.

By engaging a worm gear with the worm and connecting the side brush with the rotation shaft of the worm gear, the torque of the driving motor can be transmitted to the side brush as well as the agitator.

The easy separation and installation of the agitator and the enablement of simultaneous rotation of the agitator and a side brush can improve user satisfaction.

BEST MODE FOR CARRYING OUT THE INVENTION

Reference will now be made in detail to the embodiments of the present disclosure, examples of which are illustrated in the accompanying drawings. Although embodiments have been described with reference to a number of illustrative embodiments thereof, it should be understood that numerous other modifications and embodiments can be devised by those skilled in the art that will fall within the spirit and scope of the principles of this disclosure.

Figure 1:
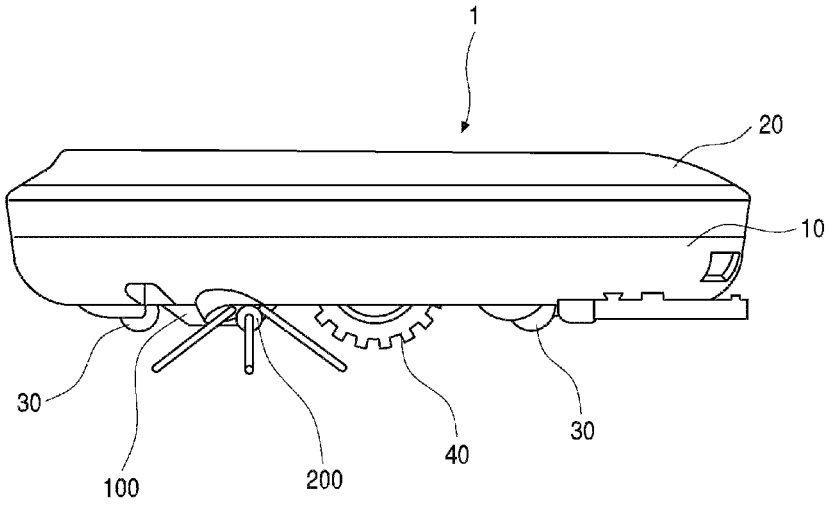
FIG. 1 is a side view illustrating a robot cleaner according to an embodiment.

FIG. 1 is a side view illustrating a robot cleaner according to an embodiment.

A main body of a robot cleaner 1 of an embodiment includes a base 10 defining a lower portion of the robot cleaner 1, and a cover 20 covering an upper side of the base 10.

The base 10 and the cover 20 define an exterior of the robot cleaner 1 by being coupled with each other. A suction motor configured to suck dust, a dust container, and a plurality of electrical components.

The base 10 includes a caster 30 and a wheel 40 configured to move the robot cleaner 1, and a side brush 200 and an agitator 100 configured to scatter foreign substances in a working area.

Figure 2:
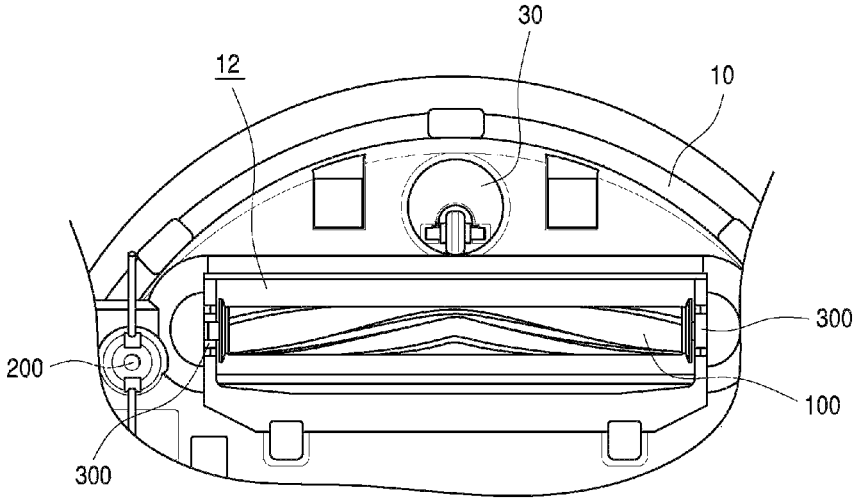
FIG. 2 is a partially enlarged view illustrating the robot cleaner according to the embodiment.

FIG. 2 is a partially enlarged bottom view illustrating the robot cleaner according to the embodiment.

A dust suction unit 12 is disposed at a lower portion of the base 10 to suck dust therein.

The dust suction unit 12 is a long and narrow opening formed in a horizontal direction of the base 10, and holders 300 are disposed at both sides of the dust suction unit 12 for the installation of the agitator 100.

The holders 300, which hold the agitator 100 fitted in the holders 300, are configured to transmit a torque of a driving motor 400 (that will be described below) to the agitator 100.

Figure 3:
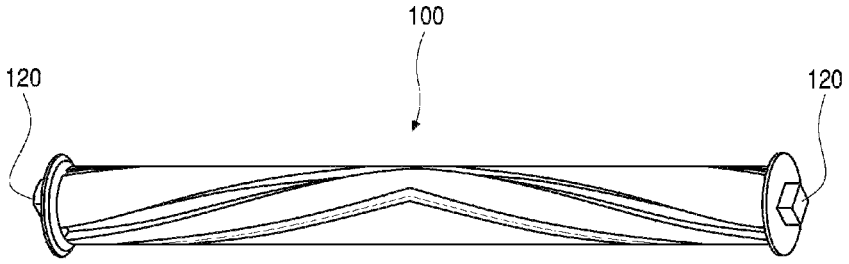
FIG. 3 is a perspective view illustrating an agitator according to the embodiment.
Figure 4:
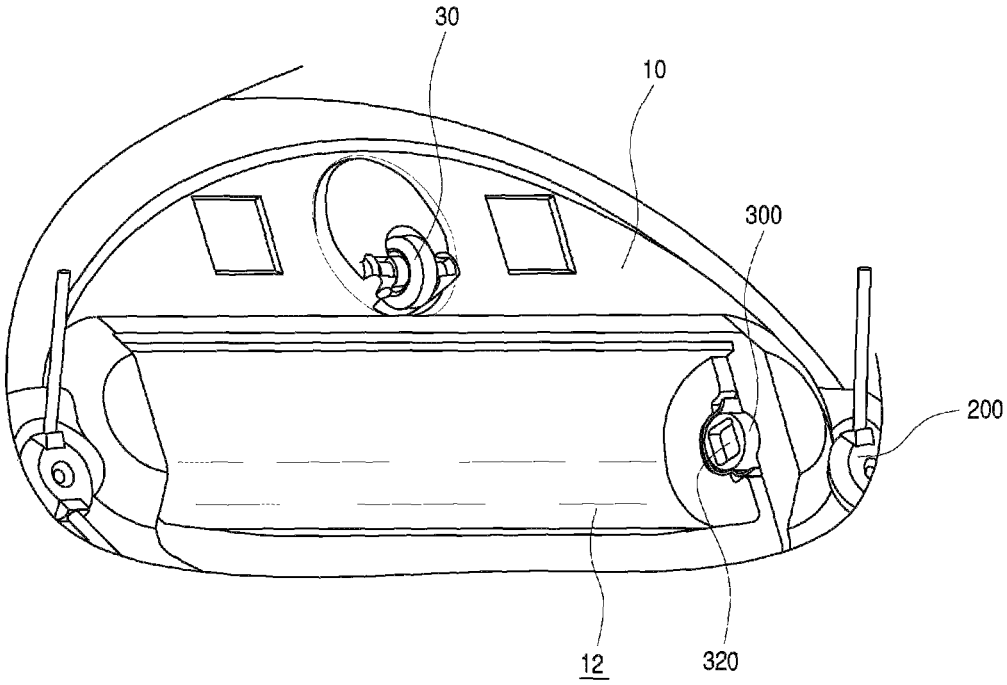
FIGS. 4 and 5 are views illustrating a dust suction unit of the robot cleaner according to the embodiment.
Figure 5:
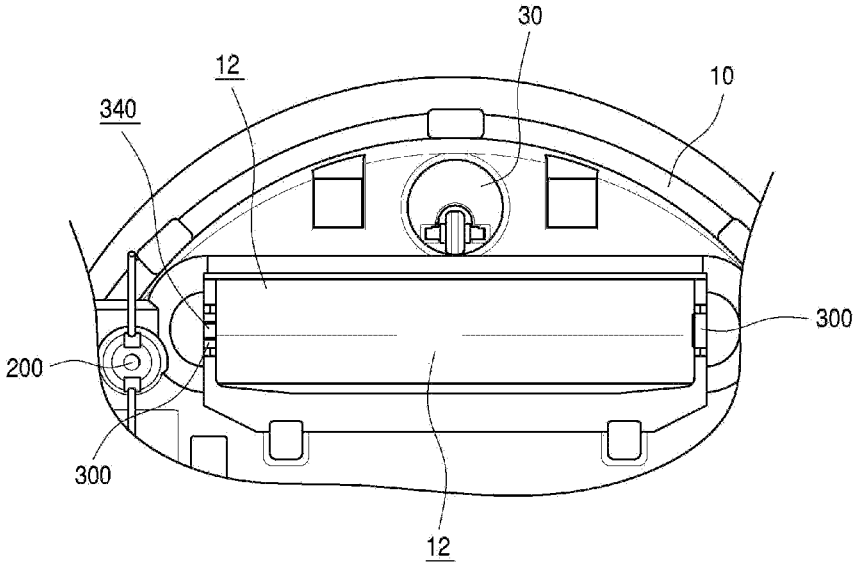
Figure 6:
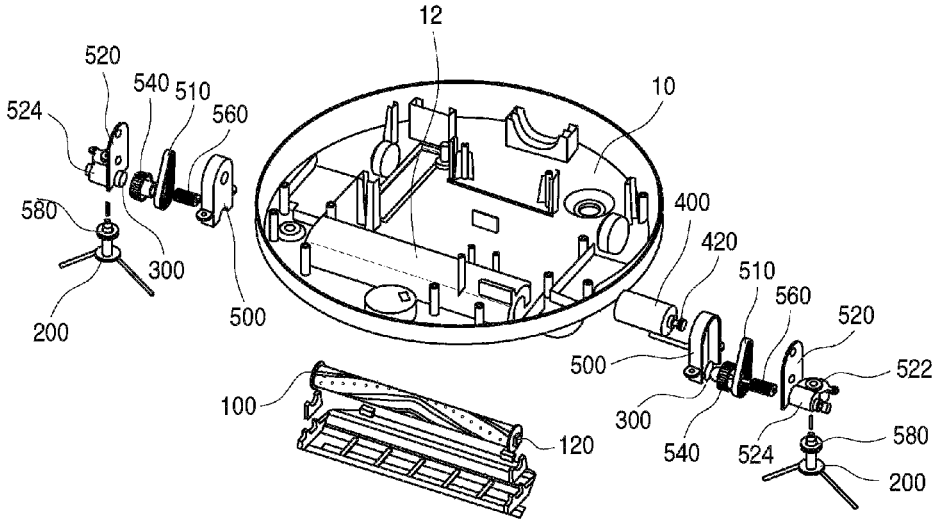
FIG. 6 is a partially exploded perspective view illustrating a mounting structure of the agitator of the robot cleaner according to the embodiment.

FIG. 3 is a perspective view illustrating the agitator according to the embodiment. FIGS. 4 and 5 are views illustrating the dust suction unit of the robot cleaner according to the embodiment. FIG. 6 is an exploded perspective view illustrating a mounting structure of the agitator of the robot cleaner according to the embodiment.

As illustrated in the drawings, fixing shafts 120 are disposed, protruding outwards, at both sides of the agitator 100, and shaft insertion parts 320 are disposed at the holders 300 to accommodate the fixing shafts 120. The shaft insertion part 320 is recessed in a shape corresponding to that of the fixing shaft 120 (refer to FIGS. 3 and 4).

The holders 300 are configured to transmit the torque of the driving motor 400, which is described below, to the agitator 100 inserted in the shaft insertion parts 320, and the shape of the shaft insertion part 320 varies depending on the shape of the fixing shaft 120.

In other words, to transmit the torque to the fixing shaft 120, the fixing shaft 120 has to be accommodated by and rotate together with the shaft insertion part 320 in engagement so that the fixing shaft 120 accommodated by the shaft insertion part 320 does not idle.

Therefore, the fixing shaft 120 may have a non-circular, i.e., oval or polygonal cylindrical, shape or at least one projection which protrudes outwards so that interference may be made between the fixing shaft 120 and the shaft insertion part 320. The shaft insertion part 320 may have a shape corresponding to the abovementioned shape.

The depth of the recess of the shaft insertion part 320 may be the same as or slightly longer than the extent to which the fixing shaft 120 protrudes.

The holders 300 are disposed at both sides of the dust suction unit 12 to support both sides of the agitator 100. At least one of the holders 300 has an opening in a side surface to form a coupling hole 340 so that the fixing shaft 120 may be inserted into from above.

The length of the agitator 100 including the fixing shafts 120 is longer than the distance between the holders 300 disposed at both sides of the dust suction unit 12.

In others words, the distance between the holders 300 may be equivalent to the length of the agitator 100 excluding the length of the fixing shafts 120 which are accommodated by the holder 300, or be shorter than the length of the agitator 100 including the length of the fixing shafts 120.

The agitator 100 is hard to be installed horizontally. When the agitator 100 is installed, the fixing shaft 120 disposed at one side of the agitator 100 is put first diagonally in one of the holders 300, and then the other fixing shaft 120 is inserted in the other holder 300.

Here, the coupling hole 340 may not be formed in the holder 300 in which the fixing shaft 120 is put first. However, the coupling hole 340 has to be formed at the other holder 300 in which the other fixing shaft 120 is put.

By placing the other fixing shaft 120 at the coupling hole 340 and pressing the other fixing shaft 120 so that the agitator 100 may level off inside the dust suction unit 12, the other fixing shaft 120 may be inserted in the other holder 300 passing through the coupling hole 340.

For the agitator 100 having the abovementioned installation structure to rotate, the torque of the driving motor 400 has to be transmitted to the holder 300.

The driving motor 400, which is disposed separately from the suction motor inside the base 10, rotates the agitator 100 and the side brush 200. Also, the driving motor 400 is disposed on a side of gear housings 500 disposed at both sides of the dust suction unit 12 to maintain a fixed position thereof.

Accommodated in the gear housing 500 are a pinion gear 420 connected to the rotation shaft of the driving motor 400 for synchronous rotation, and a pulley 540 which is coupled with the pinion gear 420 by a driving force transmitter 510 such as a belt or a chain and rotates together with the pinion gear 420.

To this end, the gear housing 500 includes a surface facing the agitator 100 and a boundary surface protruding from an edge thereof. Although not illustrated, formed at the surface facing the agitator 100 in the form of a bore or a hole are a motor shaft mounting hole which the rotation shaft of the driving motor 400 passes through and an exposed holder part which the fixing shaft 120 is put therein.

The housing gear 500 is covered by a housing cover 520 with the pinion gear 420, the pulley 520, and the driving force transmitter 510 rotatably fixed.

In other words, a space is formed in the gear housing 500 with the housing cover 520 coupled with the boundary surface of the gear housing 500 or the housing cover 520 fixed covering the boundary surface in entirety. The pinion gear 420, the pulley 520, and the driving force transmitter 510 may be fixed in the space by a bush (not illustrated), which allows the rotation shafts of the pinion gear 420 and the pulley 520 to be fixed, at the inner side of the gear housing 500 and the housing cover 520.

The holder 300, fixed to the pulley 540, rotates synchronously with the pulley 540. The installation position of the holder 300 fixed to the pulley 540 is exposed to the exposed holder part of the gear housing 500, and the fixing shaft 120 may be coupled with the holder 300.

When the fixing shaft 120 is installed at the holder 300, the torque of the driving motor 400 is transmitted to the fixing shaft 120 through the pinion gear 420, the driving force transmitter 510, the pulley 540, and the holder 300, rotating the agitator 100 and allowing the dust in a working area to be scattered.

The housing cover 520 further includes a worm gear receiver 522 and a worm receiver 524 to accommodate a worm 560 and a worm gear 580 configured to rotate the side brush 200.

Figure 7:
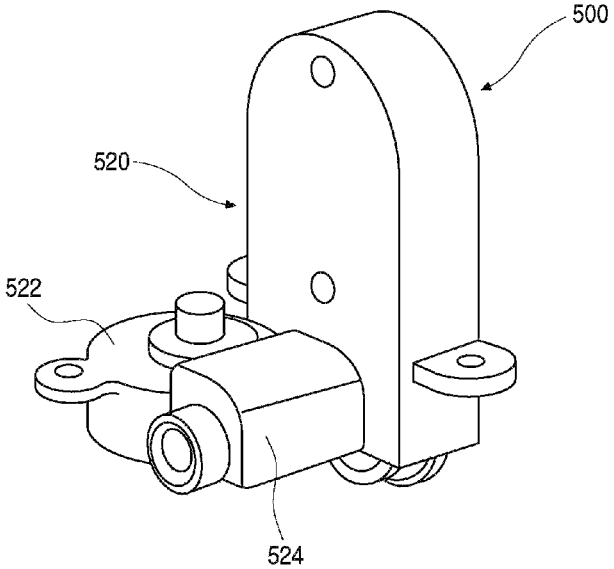
FIG. 7 is a view illustrating a coupled state of a gear housing and a housing cover which are main components according to the embodiment.

FIG. 7 is a view illustrating a coupled state of a gear housing and a housing cover which are main components according to the embodiment.

As illustrated, the worm receiver 524 is disposed at the housing cover 520 coupled with the gear housing 500 to accommodate the worm 560 which has the same rotation shaft as the pulley 540 or a separate rotation shaft connected to the rotation shaft of the pulley 540.

The torque of the driving motor 400 may be transmitted to the agitator 100 and the worm 560 at the same time because the worm 560 is positioned on the same line as the pulley 540, the holder 300, and the fixing shaft 120 of the agitator 100.

Intersecting with the worm receiver 524, the worm gear receiver 522 allows the worm 560 and the worm gear 580 to rotate together with each other in engagement, and the side brush 200 is coupled with the rotation shaft of the worm gear 580.

Figure 8:
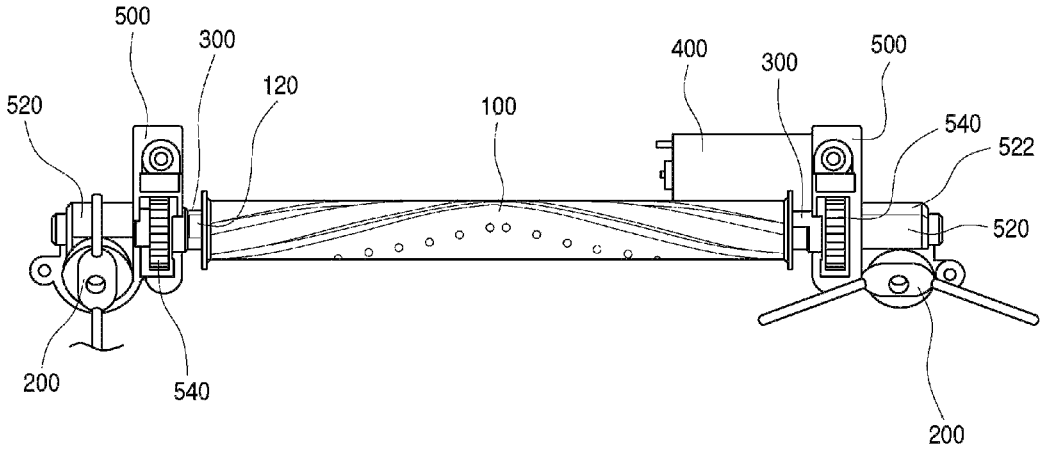
FIG. 8 is a view illustrating an operation structure of the agitator and a side brush of the robot cleaner according to the embodiment work.
Figure 9:
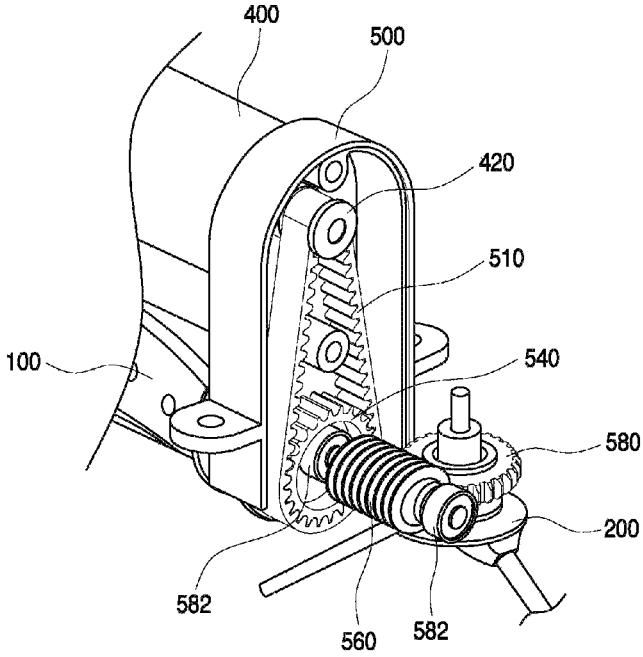
FIG. 9 is a view illustrating a coupling relation for an operation of the side brush of the robot cleaner according to the embodiment.

FIG. 8 is a view illustrating an operation structure of the agitator and the side brush of the robot cleaner according to the embodiment work, and FIG. 9 is a view illustrating a coupling relation for an operation of the side brush of the robot cleaner according to the embodiment.

As illustrated, the pinion gear 420 is coupled with the rotation shaft of the driving motor 400 which passes through the motor shaft mounting hole formed at the gear housing 500.

Since one side of the belt-shaped driving force transmitter 510 is wound at the pinion gear 420 and the pulley 540 accommodated inside the gear housing 500 is wound at the other side, the pinion gear 420 and the pulley 540 may rotated together when the driving motor 400 rotates.

The fixing shaft 120 of the agitator 100 may be inserted because the holder 300 is coupled with the pulley 540 at the surface facing the agitator 100. The torque may be transmitted to the side brush 200 because the worm 560 is coupled with the pulley 540 at the surface toward the side brush 200.

Here, for smooth rotation, a bearing 582 may be further disposed at both sides of the rotation shaft of the pulley 540 and the worm 560.

The worm gear 580, accommodated by the worm gear receiver 522, is fixed at the worm 560 in such a manner that the worm gear 580 may rotate in engagement with the worm 560. In addition, the side brush 200 is coupled with the rotation shaft of the worm gear 580 for synchronous rotation. In the abovementioned manner, the torque of the driving motor 400 is transmitted to the side brush 200.

The invention claimed is:

1. A robot cleaner comprising:

a main body in which a dust suction unit is disposed;

holders disposed at sides of the dust suction unit; and an agitator installed on the holders to remove foreign substances from a working area, wherein the agitator comprises a fixing shaft having a non-circular shape and providing a rotation center, and one of the holders comprises a shaft insertion part in which one portion of the fixing shaft is inserted, wherein the fixing shaft is rotated together with the agitator, and wherein another of the holders comprises a coupling hole in which another portion of the fixing shaft is inserted, the coupling hole is opened with a length corresponding to a width of the another portion of the fixing shaft.

2. The robot cleaner according to claim 1, wherein the holders are disposed on both sides of the dust suction unit.

3. The robot cleaner according to claim 1, wherein in a state where the portion of the fixing shaft is mounted on the shaft insertion part of the one holder, the another portion of the fixing shaft passes through the coupling hole of the another of the holders.

4. The robot cleaner according to claim 1, wherein the shaft insertion part has a depth recessed corresponding to a protrusion length of the portion of the fixing shaft or greater than the protrusion length of the portion of the fixing shaft.

5. The robot cleaner according to claim 1, wherein the holders are respectively disposed at both sides of the dust suction unit, and a distance between the holders is less than a length of the agitator excluding the fixing shaft and greater than a length of agitator including the fixing shaft.

6. The robot cleaner according to claim 1, further comprising:

a pinion gear fixed to a rotation shaft of a driving motor for synchronous rotation;

a pulley coupled with the holder for synchronous rotation; and a driving force transmitter connecting the pulley with the pinion gear, wherein the pinion gear, the pulley, and the driving force transmitter are disposed between the driving motor and at least one of the holders.

7. The robot cleaner according to claim 6, wherein the pinion gear, the pulley, and the driving force transmitter are disposed in an inner space defined by a gear housing to which the driving motor is fixed and a housing cover coupled with the gear housing.

8. The robot cleaner according to claim 6, wherein a worm for rotation of a side brush is connected to the pulley for synchronous rotation.

9. The robot cleaner according to claim 6, wherein a worm receiver and a worm gear receiver for rotation of a side brush are disposed in the housing cover, and a worm disposed in the worm receiver is connected to the pulley and holder so that the worm has the same rotation center as those of the rotation shafts of the pulley and the holder.

10. A robot cleaner comprising:

a main body in which a dust suction unit is disposed;

holders disposed at sides of the dust suction unit; and an agitator installed on the holders to remove foreign substances from a working area, wherein the agitator comprises a first fixing shaft having a non-circular shape and protruded from one side thereof, and a second fixing shaft protruded from the other side of the agitator, wherein the holders comprises a first holder provided with a shaft insertion part in which the first fixing shaft is inserted, and a second holder provided with a coupling portion in which the second fixing shaft is inserted after inserting the first fixing shaft in the shaft insertion part, wherein the first holder is rotated together with the agitator.

11. A robot cleaner comprising:

a main body in which a dust suction unit is disposed;

holders disposed at sides of the dust suction unit; and an agitator installed on the holders to remove foreign substances from a working area, wherein the agitator comprises a first fixing shaft and protruded from one side thereof, and a second fixing shaft having a non-circular shape and protruded from the other side of the agitator, wherein the holders comprises a first holder provided with a shaft insertion part in which the first fixing shaft is inserted, and a second holder provided with a coupling portion in which the second fixing shaft is inserted after inserting the first fixing shaft in the shaft insertion part, wherein the second holder is rotated together with the agitator.

* * * * *